US011194267B2

(12) United States Patent
Nakamura et al.

(10) Patent No.: US 11,194,267 B2
(45) Date of Patent: Dec. 7, 2021

(54) DEVELOPER CONTAINER, PROCESS CARTRIDGE, AND IMAGE FORMING APPARATUS

(71) Applicant: CANON KABUSHIKI KAISHA, Tokyo (JP)

(72) Inventors: Shota Nakamura, Yokohama (JP); Yuuki Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/816,421

(22) Filed: Mar. 12, 2020

(65) Prior Publication Data

US 2020/0209782 A1 Jul. 2, 2020

Related U.S. Application Data

(63) Continuation of application No. 15/793,053, filed on Oct. 25, 2017, now Pat. No. 10,620,563.

(30) Foreign Application Priority Data

Oct. 31, 2016 (JP) ..... JP2016-212464
Sep. 4, 2017 (JP) ..... JP2017-169287

(51) Int. Cl.
*G03G 15/08* (2006.01)

(52) U.S. Cl.
CPC ..... *G03G 15/0881* (2013.01); *G03G 15/0806* (2013.01); *G03G 15/0808* (2013.01);
(Continued)

(58) Field of Classification Search
CPC ..... G03G 15/0808; G03G 15/0806; G03G 15/0881; G03G 15/0898; G03G 15/0865;
(Continued)

(56) References Cited

U.S. PATENT DOCUMENTS 7,292,797 B2 11/2007 Kunugi et al.
7,356,281 B2 4/2008 Miyakawa et al.
(Continued)

FOREIGN PATENT DOCUMENTS

CN 1664713 A 9/2005
CN 1673877 A 9/2005
(Continued)

OTHER PUBLICATIONS

Singaporean Office Action dated Feb. 22, 2018, in related Singaporean Patent Application No. 10201708904P.
(Continued)

*Primary Examiner* — Ryan D Walsh
(74) *Attorney, Agent, or Firm* — Venable LLP

(57) ABSTRACT

A developer container includes a frame having a developer storage chamber which stores a conveying member, a developing chamber in which a developer bearing member and a supplying member are arranged, a partition partitioning the developer storage chamber and the developing chamber and provided with a first opening, and a second opening which connects an interior of the developing chamber and an exterior of the frame. A filter allows passage of air and restricts passage of the developer, with the filter being fixed to the frame so as to cover the second opening. The conveying member is deformable such that the developer is conveyed from the developer storage chamber to the developing chamber via the first opening by deformation of the conveying member being released, and the conveying member conveys the developer such that the developer passes above the supplying member.

32 Claims, 8 Drawing Sheets

(52) U.S. Cl.
CPC ..... *G03G 15/0865* (2013.01); *G03G 15/0889* (2013.01); *G03G 15/0896* (2013.01); *G03G 15/0898* (2013.01); *G03G 15/0875* (2013.01)

(58) Field of Classification Search
CPC ..... G03G 15/0896; G03G 15/0889; G03G 15/0875; G03G 15/0877
See application file for complete search history.

(56) References Cited

U.S. PATENT DOCUMENTS

| | | | | |
|---|---|---|---|---|
| 7,529,503 | B2 | 5/2009 | Miyakawa et al. | |
| 8,385,770 | B2 | 2/2013 | Yamada et al. | |
| 8,406,650 | B2 | 3/2013 | Kunihiro et al. | |
| 8,428,474 | B2 | 4/2013 | Satomura | |
| 8,483,589 | B2 | 7/2013 | Uneme et al. | |
| 8,620,191 | B2 | 12/2013 | Okazaki et al. | |
| 9,594,342 | B2 | 3/2017 | Fujiwara et al. | |
| 9,785,086 | B2 | 10/2017 | Maeshima et al. | |
| 2011/0008068 | A1 | 1/2011 | Kunihiro et al. | |
| 2011/0311263 | A1 | 12/2011 | Mizuta | |
| 2013/0287451 | A1 | 10/2013 | Yamamoto et al. | |
| 2014/0064776 | A1 | 3/2014 | Yamasaki et al. | |
| 2014/0270838 | A1 | 9/2014 | Yoshizawa et al. | |
| 2016/0252877 | A1 | 9/2016 | Nakamura et al. | |
| 2016/0282763 | A1 | 9/2016 | Maeshima et al. | |
| 2020/0073287 | A1 * | 3/2020 | Akiba | G03G 21/181 |

FOREIGN PATENT DOCUMENTS

| | | | | | |
|---|---|---|---|---|---|
| CN | 101950136 | A | | 1/2011 | |
| CN | 102200750 | A | | 9/2011 | |
| EP | 2317397 | A2 | | 5/2011 | |
| JP | 61140968 | A | * | 6/1986 | G03G 15/0898 |
| JP | 2003-270939 | A | | 9/2003 | |
| JP | 2008-216467 | A | | 9/2008 | |
| JP | 2009-036875 | A | | 2/2009 | |
| JP | 2009-037063 | A | | 2/2009 | |
| JP | 2009-053274 | A | | 3/2009 | |
| JP | 2009-109863 | A | | 5/2009 | |
| JP | 2009-122509 | A | | 6/2009 | |
| JP | 2010-107899 | A | | 5/2010 | |
| JP | 2010-237635 | A | | 10/2010 | |
| JP | 2011-017867 | A | | 1/2011 | |
| JP | 2011-112826 | A | | 6/2011 | |
| JP | 4790676 | B2 | | 10/2011 | |
| JP | 2012-003193 | A | | 1/2012 | |
| JP | 2013-195451 | A | | 9/2013 | |
| JP | 2013-210436 | A | | 10/2013 | |
| JP | 5751779 | B2 | | 7/2015 | |
| JP | 2016-035545 | A | | 3/2016 | |
| JP | 2016-184143 | A | | 10/2016 | |
| JP | 2016-186579 | A | | 10/2016 | |

OTHER PUBLICATIONS

European Search Report dated Mar. 7, 2018, in related European Patent Application No. 17199121.9.
Singaporean Notice of Allowance dated Oct. 16, 2018, in related Singaporean Patent Application No. 10201708904P.
Japanese Office Action dated Jul. 2, 2019, in related Japanese Patent Application No. 2017-169287.
Chinese Office Action dated Jun. 1, 2020, in related Chinese Patent Application No. 201711031394.7 (with English translation).

* cited by examiner

DEVELOPER CONTAINER, PROCESS CARTRIDGE, AND IMAGE FORMING APPARATUS

This application is a continuation of application Ser. No. 15/793,053, filed Oct. 25, 2017.

BACKGROUND OF THE INVENTION

Field of the Invention

The present invention relates to a developer container for housing a developer used to form an image on a recording medium. The present invention further relates to a process cartridge which forms a developer image on a photosensitive drum and which is attachable to and detachable from an image forming apparatus, and to an image forming apparatus which forms an image on a recording medium using a developer.

Description of the Related Art

With an image forming apparatus such as a printer which uses an electrophotographic image formation system (an electrophotographic process), when an image is formed on a recording material, a photosensitive drum is first uniformly charged by a charging roller. Next, the charged photosensitive drum is selectively exposed by an exposing apparatus to form an electrostatic latent image on the photosensitive drum. In addition, the electrostatic latent image formed on the photosensitive drum is developed as a toner image using toner by a developing apparatus. Subsequently, the toner image formed on the photosensitive drum is transferred onto a recording material such as recording paper or a plastic sheet, and the toner image transferred onto the recording material is fixed to the recording material by being subjected to heat and pressure by a fixing apparatus. In this manner, an image is formed on the recording material. In addition, toner that remains on the photosensitive drum after the toner image is transferred to the recording material is removed by a cleaning blade.

With such an image forming apparatus, generally, processing means such as a photosensitive drum, a charging roller, and a developing apparatus require maintenance. In recent years, in order to facilitate the maintenance of such processing means, the photosensitive drum, the charging roller, the developing apparatus, and a cleaning blade are integrated into a cartridge. Generally, a cartridge including such processing means is called a process cartridge. The process cartridge can be attached to and detached from an apparatus main body of the image forming apparatus and, by replacing the process cartridge, processing means can be replaced and maintenance can be performed thereon.

Conventionally, in-line system image forming apparatuses are known in which a plurality of photosensitive drums are approximately horizontally arranged and in which a toner image on the photosensitive drums is transferred to a recording material via an intermediate transfer belt. In addition, in such image forming apparatuses, there are those in which the plurality of photosensitive drums, a developing apparatus, and an exposing apparatus are arranged below the intermediate transfer belt. When the photosensitive drums, the developing apparatus, and the exposing apparatus are arranged below the intermediate transfer belt, the photosensitive drums, the developing apparatus, and the exposing apparatus are to be arranged inside the image forming apparatus on an opposite side of a fixing apparatus with respect to the intermediate transfer belt. Therefore, the photosensitive drums, the developing apparatus, and the exposing apparatus can be arranged at distant positions from the fixing apparatus. Accordingly, an impact of heat from the fixing apparatus on the photosensitive drums, the developing apparatus, and the exposing apparatus can be suppressed.

As described above, when the photosensitive drums, the developing apparatus, and the exposing apparatus are arranged below the intermediate transfer belt, generally, a developing chamber in which is arranged a developing roller bearing toner to be used in development is arranged above a toner storage chamber in which toner is stored. In addition, the developing chamber and the toner storage chamber communicate with each other via an opening. In such a developing apparatus, the toner stored in the toner storage chamber must be conveyed through the opening and to the developing chamber arranged above the toner storage chamber against gravity.

In consideration thereof, conventionally, a sheet-like stirring member is provided in the developing apparatus (the developer container) and, by rotating, the stirring member kicks up toner accumulated at a bottom of the toner storage chamber into the developing chamber. Specifically, the sheet-like stirring member rotates around an axis of a rotational center extending approximately in a horizontal direction to lift up toner accumulated at the bottom of the toner storage chamber. In addition, in a state where the stirring member is lifting up the toner, the stirring member comes into contact with an inner wall surface of the toner storage chamber and deflects. Subsequently, as a contact state between the inner wall surface of the toner storage chamber and the stirring member is released, the stirring member is restored to its original shape and toner on the stirring member is kicked up into the developing chamber against gravity by the restorative force.

A developer container is generally provided with a developing roller which is rotatably supported against a frame of the developer container and a developing blade which adjusts a layer thickness of toner borne by the developing roller. In addition, the developer container is provided with a sheet member which closes a gap between the frame and the developing roller of the developer container so as to prevent toner from leaking out from the gap between the frame and the developing roller. Furthermore, the developer container is provided, in a vicinity of ends in an axial direction of a rotational center of the developing roller, with a seal member for closing a gap between the developing roller and the frame, a gap between the developing blade and the frame, and a gap between the sheet member and the frame. Accordingly, leakage of the toner inside the developer container to an exterior of the developer container is suppressed. However, when pressure inside the developer container rises, a pressure difference is created between an interior and the exterior of the developer container, thereby creating a risk that toner may leak out from a gap between the sheet member and the developing roller or gaps between the frame of the developer container and the like and the seal member.

With a technique disclosed in Japanese Patent No. 5751779, in a configuration in which a developing chamber is arranged below a toner storage chamber, an opening is provided on an inner wall of the developing chamber and the opening is covered by an air-permeable filter. Accordingly, even when an impact is applied to the developing apparatus, since air is discharged from the opening and pressure inside the developing chamber decreases, toner can be prevented from leaking out of the developing apparatus.

In addition, with a technique disclosed in Japanese Patent No. 4790676, a developing chamber is not provided in a developing apparatus and a developing roller is arranged above a screw for conveying toner inside a toner storage chamber. Furthermore, an opening is provided on an inner wall of the toner storage chamber and the opening is covered by an air-permeable filter. When an air flow is created toward the opening, an air flow created by a rotation of the developing roller causes toner floating inside the developing apparatus to be captured by the filter.

With a developer container in which a sheet-like stirring member supplies toner into a developing chamber, a rotation of the stirring member causes the stirring member to convey not only the toner but also air into the developing chamber. Therefore, when pressure inside the developer container rises as the stirring member rotates and a pressure difference is created between the interior and the exterior of the developer container, a risk is created in that toner may leak out from a gap between the sheet member and the developing roller, a gap between the frame of the developer container and the seal member, and the like.

Furthermore, recent increases in image formation speed (printing speed) of image forming apparatuses call for a larger amount of toner to be supplied to a developing chamber. In order to do so, a rotational speed of a sheet-like stirring member must be increased or a thickness of the stirring member must be increased.

However, in such cases, since a larger amount of air is conveyed inside the developing chamber by a rotation of the stirring member, pressure inside the developing chamber rises and, consequently, a risk is created in that toner may leak out from a gap between a sheet member and a developing roller and the like as described above.

SUMMARY OF THE INVENTION

In consideration thereof, an object of the present invention is to suppress, in a developer container in which toner is conveyed from a toner storage chamber to a developing chamber by a rotation of a stirring member, leakage of the toner from inside the developing chamber.

In order to achieve the object described above, a developer container according to the present invention including: a developer bearing member for bearing a developer; a conveying member which conveys the developer, the conveying member being deformable and conveying the developer as deformation is released by rotating; a frame which stores the developer, the frame including a developer storage chamber which stores the conveying member, a developing chamber which stores the developer bearing member, a first opening which connects the developer storage chamber and the developing chamber with each other and which allows passage of the developer conveyed from the developer storage chamber to the developing chamber, and a second opening which connects an interior of the developing chamber and an exterior of the frame with each other in an orthogonal direction that is orthogonal to a direction of a rotational axis of the conveying member; a sealing member which suppresses leakage of the developer from between the frame and the developer bearing member; and a filter which allows passage of air through the second opening and which restricts passage of the developer through the second opening, the filter being fixed to the frame.

In addition, in order to achieve the object described above, a developer container according to the present invention including: a developer bearing member for bearing a developer; a supplying member which supplies the developer to the developer bearing member by coming into contact with the developer bearing member; a conveying member which conveys the developer, the conveying member being deformable and conveying the developer as deformation is released by rotating; a frame which stores the developer, the frame including a developer storage chamber which stores the conveying member, a developing chamber which stores the developer bearing member and the supplying member, a first opening which connects the developer storage chamber and the developing chamber with each other and which allows passage of the developer conveyed from the developer storage chamber to the developing chamber, a second opening which connects an interior of the developing chamber and an exterior of the frame with each other in an orthogonal direction that is orthogonal to a direction of a rotational axis of the conveying member, and a third opening in which the developer bearing member is arranged; a sealing member which suppresses leakage of the developer from between the frame and the developer bearing member, the sealing member including end seals arranged at both edge sections of the third opening in a longitudinal direction thereof, and a sealing sheet which is fixed to the frame and which comes into contact with the developer bearing member between the end seals; and a filter which allows passage of air through the second opening and which restricts passage of the developer through the second opening, the filter being fixed to the frame.

Furthermore, in order to achieve the object described above, a process cartridge according to the present invention including: the developer container; and an image bearing member on which a developer image is formed, the process cartridge being attachable to and detachable from an apparatus main body of an image forming apparatus.

In addition, in order to achieve the object described above, an image forming apparatus according to an embodiment of the present invention including: the developer container; an image bearing member on which a developer image is formed; and a fixing apparatus which fixes the developer image to a recording medium.

Further features of the present invention will become apparent from the following description of exemplary embodiments (with reference to the attached drawings).

DESCRIPTION OF THE EMBODIMENTS

Embodiment

An embodiment of the present invention will now be exemplarily described with reference to the drawings. However, it is to be understood that dimensions, materials, shapes, relative arrangements, and the like of components described in the embodiment are intended to be modified as deemed appropriate in accordance with configurations and various conditions of apparatuses to which the present invention is to be applied and are not intended to limit the scope of the invention to the embodiment described below.

Electrophotographic Image Forming Apparatus 100

Figure 2:
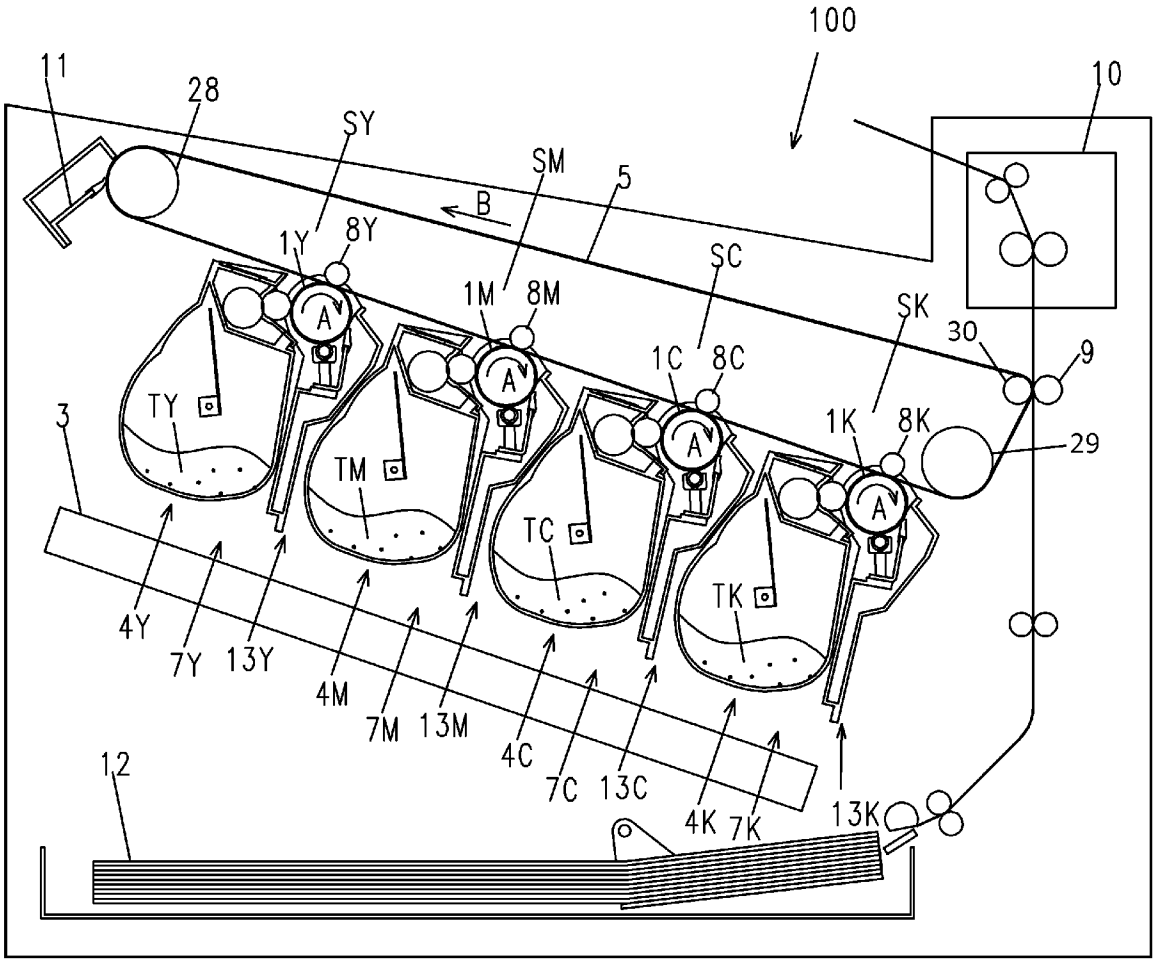
FIG. 2 is a schematic sectional view of an image forming apparatus according to an embodiment.
Figure 3:
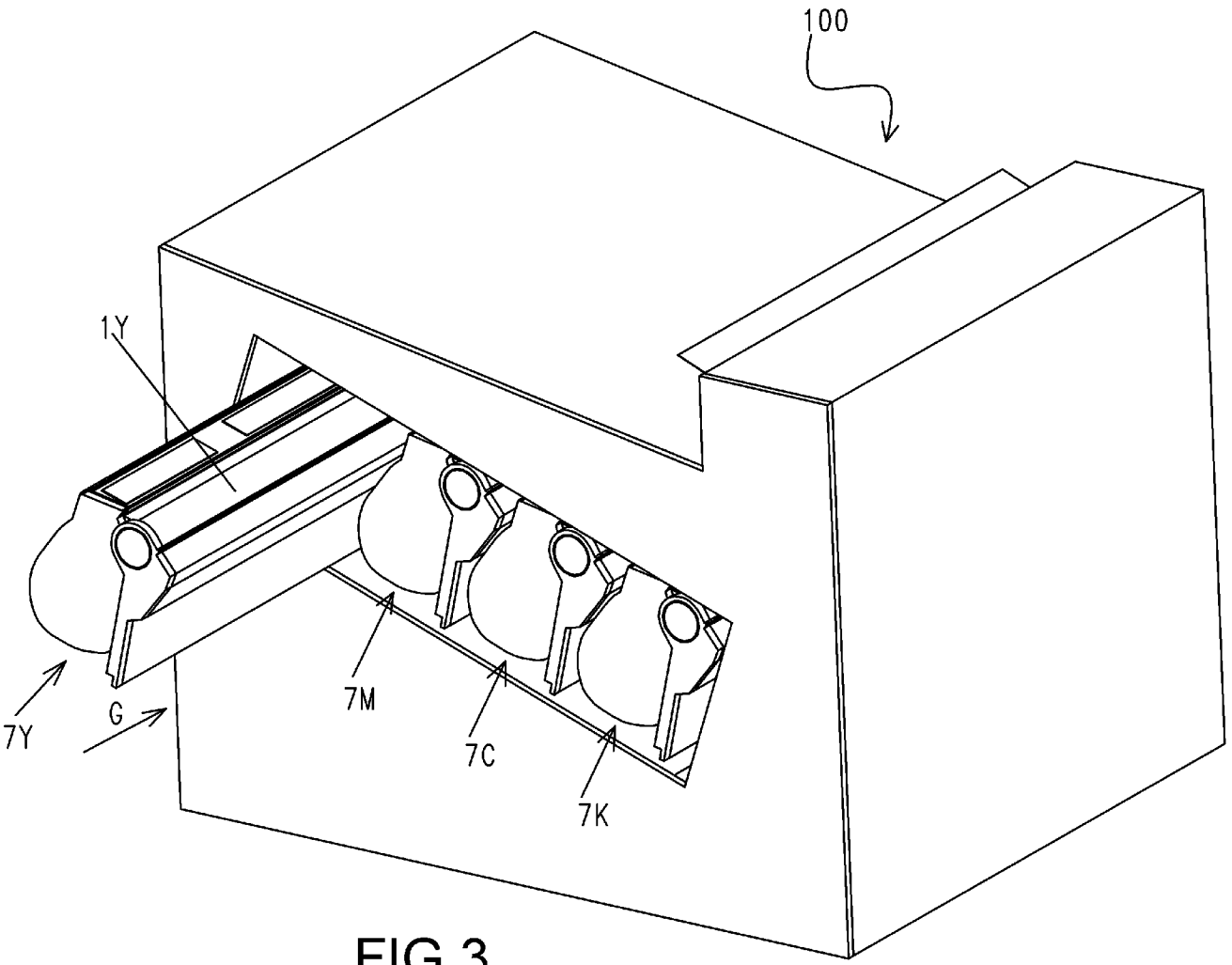
FIG. 3 is a diagram showing how a process cartridge is inserted into an apparatus main body of an image forming apparatus.

An overall configuration of an electrophotographic image forming apparatus 100 (an image forming apparatus 100) according to the present embodiment will be described with reference to FIGS. 2 and 3. FIG. 2 is a schematic view of the image forming apparatus 100 according to the present embodiment. In addition, FIG. 3 is a perspective view showing a state where a process cartridge 7 is mounted to the image forming apparatus 100. As a plurality of image forming sections, the image forming apparatus 100 includes first to fourth image forming sections SY to SK for forming images of yellow (Y), magenta (M), cyan (C), and black (K). Moreover, in the present embodiment, the process cartridge 7 is configured to be attachable to and detachable from an apparatus main body of the image forming apparatus 100.

In the present embodiment, configurations and operations of the first to fourth image forming sections are substantially the same with the exception of differences in colors of formed images. Therefore, unless the image forming sections need to be particularly distinguished from each other in the following description, the image forming sections will be generally described by omitting the suffixes Y to K. In the present embodiment, the image forming apparatus 100 includes photosensitive drums 1 (1Y to 1K) as four image bearing members. The photosensitive drum 1 rotates in a direction of an arrow A in FIG. 2. A charging roller 2 (2Y to 2K) and a scanner unit 3 are arranged in a periphery of the photosensitive drum 1.

In this case, the charging roller 2 (refer to FIG. 1) is charging means which uniformly charges a surface of the photosensitive drum 1. The charging roller 2 is biased in a direction of an arrow C in FIG. 1 toward the photosensitive drum 1. In addition, the scanner unit 3 is exposing means which irradiates a laser based on image information and forms an electrostatic latent image on the photosensitive drum 1 (which corresponds to the image bearing member). Furthermore, a developing unit 4 (4Y to 4K) as a developing apparatus and a cleaning blade 6 (refer to FIG. 1) as cleaning means are arranged in a periphery of the photosensitive drum 1. In this case, the developing unit 4 at least includes a developing roller 22 (refer to FIG. 1) as a developer bearing member which bears a developer.

Furthermore, an intermediate transfer belt 5 (which corresponds to the intermediate transfer member) for transferring a toner image (which corresponds to the developer image) on the photosensitive drum 1 to a recording material 12 (which corresponds to the recording medium) is arranged so as to oppose the four photosensitive drums 1. In addition, in the present embodiment, toner T (TY to TK) which is a non-magnetic single component toner is used in the developing unit 4. In the present embodiment, the developing unit 4 performs contact development by bringing the developing roller 22 into contact with the photosensitive drum 1.

In addition, a photosensitive member unit 13 includes a removed toner housing section (refer to FIG. 1) which houses transfer residual toner (waste toner) remaining on the photosensitive drum 1, the photosensitive drum 1, the charging roller 2, and the cleaning blade 6. Furthermore, in the present embodiment, a process cartridge 7 (7Y to 7K) is configured by integrating the developing unit 4 and the photosensitive member unit 13 into a cartridge. The process cartridge 7 is configured to be attachable to and detachable from the image forming apparatus 100 via mounting means (not shown) such as a mounting guide or a positioning member provided on the image forming apparatus 100. In addition, the process cartridge 7 at least includes the photosensitive drum 1 that bears a developer image.

In the present embodiment, the process cartridge 7 is mountable to the apparatus main body of the image forming apparatus 100 in a direction of an arrow G in FIG. 3 which is a rotational axis direction of the photosensitive drum 1. In the present embodiment, the process cartridges 7 for the respective colors all have the same shape. However, this configuration is not restrictive and the process cartridges 7 may have different shapes and sizes. For example, the cartridge for black may be made larger than the other cartridges in order to increase capacity. In addition, the process cartridges 7 for the respective colors store toners T (TY to TK) of the respective colors yellow (Y), magenta (M), cyan (C), and black (K). The intermediate transfer belt 5 is in contact with all of the photosensitive drums 1 and moves in a direction of an arrow B in FIG. 2. The intermediate transfer belt 5 is stretched over a plurality of supporting members (a driver roller 29, a secondary transfer opposing roller 30, and a driven roller 28). Four primary transfer rollers 8 (8Y to 8K) (which correspond to the primary transfer members) are arranged parallel to each other on a side of an inner peripheral surface of the intermediate transfer belt 5 so as to oppose the respective photosensitive drums 1. In addition, a secondary transfer roller 9 is arranged at a position opposing the secondary transfer opposing roller 30 on a side of an outer peripheral surface of the intermediate transfer belt 5.

Image Forming Process

During image formation, first, the surface of the photosensitive drum 1 is uniformly charged by the charging roller 2. Next, due to laser light irradiated from the scanner unit 3, the surface of the photosensitive drum 1 is subjected to scanning exposure and an electrostatic latent image based on image information is formed on the photosensitive drum 1. The electrostatic latent image formed on the photosensitive drum 1 is developed by the developing unit 4 as a toner image. The toner image formed on the photosensitive drum 1 is primarily transferred onto the intermediate transfer belt 5 by the primary transfer roller 8.

For example, when forming a full-color image, due to the process described above being sequentially performed by the image forming sections SY to SK which are first to fourth image forming sections, toner images of the respective colors are sequentially superimposed on one another on the intermediate transfer belt 5. Subsequently, the recording material 12 is conveyed to the secondary transfer section in synchronization with a movement of the intermediate transfer belt 5. In addition, due to the secondary transfer roller 9 (which corresponds to the secondary transfer member) in contact with the intermediate transfer belt 5 via the recording material 12, the four-color toner image on the intermediate transfer belt 5 is collectively secondarily transferred onto the recording material 12.

Subsequently, the recording material 12 onto which the toner image has been transferred is conveyed to a fixing apparatus 10. The toner image is fixed to the recording material 12 as the recording material 12 is subjected to heat and pressure in the fixing apparatus 10. Primary transfer residual toner that remains on the photosensitive drum 1 after the primary transfer process is removed by the cleaning blade 6. In addition, secondary transfer residual toner that remains on the intermediate transfer belt 5 after a secondary transfer process is removed by an intermediate transfer belt cleaning apparatus 11. The removed transfer residual toner (waste toner) is discharged to a waste toner box (not shown) of the image forming apparatus 100. Moreover, the image forming apparatus 100 is also configured to form a single-color or multi-color image using only a single or some (not all) desired image forming sections. In the present embodiment, the developing unit 4 is arranged on an opposite side of the fixing apparatus 10 with respect to the intermediate transfer belt 5.

Process Cartridge

Figure 1:
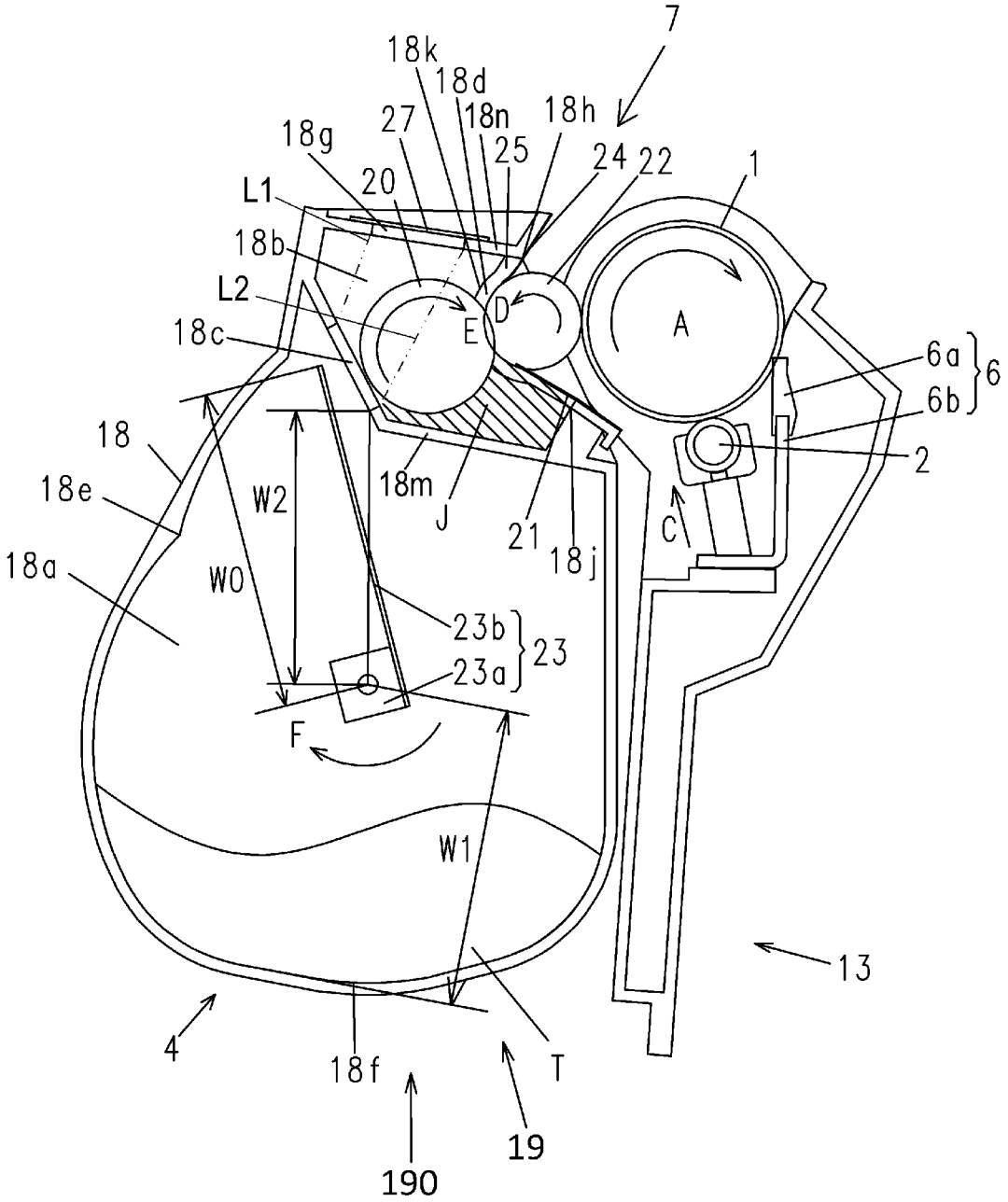
FIG. 1 is a schematic sectional view of a process cartridge according to an embodiment.

Next, an overall configuration of the process cartridge 7 to be mounted to the image forming apparatus 100 according to the present embodiment will be described with reference to FIG. 1. FIG. 1 is a schematic view of the process cartridge 7 according to the present embodiment. The developing unit 4 includes a developing frame 18 that supports the various members in the developing unit 4. In this case, a portion that houses toner in the developing frame 18 is assumed to be a container main body 19. The developing unit 4 is provided with the developing roller 22 which conveys toner to the photosensitive drum 1 by coming into contact with the photosensitive drum 1. The developing roller 22 bears toner and rotates in a direction of an arrow D (counterclockwise) in FIG. 1. In addition, the developing roller 22 is rotatably supported at both ends in a longitudinal direction (a rotational axis direction) thereof by bearings against the developing frame 18.

In addition, the developing unit 4 includes a toner storage chamber 18*a* (which corresponds to the developer storage chamber) which is a space inside the container main body 19, a developing chamber 18*b* in which the developing roller 22 is arranged, and an opening 18*c* as the first opening which connects the toner storage chamber 18*a* and the developing chamber 18*b* with each other. Furthermore, the opening 18*c* is formed in a partition portion (a partition portion 18*m* shown in FIG. 1) for partitioning the toner storage chamber 18*a* and the developing chamber 18*b*. In the present embodiment, in a posture in which the developing unit 4 is normally used (a posture during use), the developing chamber 18*b* is positioned above the toner storage chamber 18*a*. In addition, a toner supplying roller 20 (which corresponds to the supplying member) which comes into contact with the developing roller 22 and rotates in a direction of an arrow E and a developing blade 21 (which corresponds to the layer thickness restricting member) for restricting a thickness of a toner layer formed on the developing roller 22 are arranged in the developing chamber 18*b*. In this case, as shown in FIG. 1, the developing blade 21 is in contact with a surface of the developing roller 22.

As shown in FIG. 1, the developing roller 22 and the toner supplying roller 20 rotate such that, in mutual contact sections thereof, a surface of the developing roller 22 and a surface of the toner supplying roller 20 advance in a same direction. In other words, when viewed in a direction aligned with a rotational axis of the developing roller 22 or a rotational axis of the toner supplying roller 20, a rotation direction of the developing roller 22 and a rotation direction of the toner supplying roller 20 are opposite to each other.

Furthermore, a stirring member 23 for stirring toner T stored in the toner storage chamber 18*a* which is the interior of the container main body 19 and conveying the toner to the toner supplying roller 20 via the opening 18*c* is provided in the toner storage chamber 18*a*. The stirring member 23 includes a rotating shaft 23*a* that is parallel to the rotational axis direction of the developing roller 22 and a stirring sheet 23*b* that is a flexible sheet as the conveying member. In other words, a direction of a rotational axis of the stirring sheet 23*b* is parallel to the direction of the rotational axis of the developing roller 22. One end of the stirring sheet 23*b* is attached to the rotating shaft 23*a*, another end of the stirring sheet 23*b* is configured as a free end, and as the rotating shaft 23*a* rotates to rotate the stirring sheet 23*b*, toner is stirred by the stirring sheet 23*b*. The stirring member 23 rotates so as to slide against a region at least including a bottom section 18*f* of an inner wall surface of the container main body 19. Moreover, in the present embodiment, the rotating shaft 23*a* extends in an approximately horizontal direction in a posture in which the developing unit 4 is normally used.

When the stirring member 23 stirs toner, since the stirring sheet 23*b* comes into contact with the inner wall surface of the container main body 19, the stirring member 23 rotates in a state where the stirring sheet 23*b* bends. In this case, the inner wall surface of the container main body 19 has a release position 18*e* that is a position at which the stirring sheet 23*b* is released from the bended state. The stirring sheet 23*b* is released from the bended state when passing the release position 18*e* and, due to a restorative force created by the release from the bended state, toner on the stirring sheet is kicked up. The kicked-up toner is conveyed to the toner supplying roller 20 in the developing chamber 18*b* via the opening 18*c*. The photosensitive member unit 13 includes a cleaning frame that supports the various parts constituting the photosensitive member unit 13. The photosensitive drum 1 is attached to the cleaning frame so as to be rotatable in the direction of the arrow A shown in FIG. 1.

In addition, the cleaning blade 6 is constituted by an elastic member 6*a* for removing transfer residual toner (waste toner) that remains on the surface of the photosensitive drum 1 after primary transfer and a supporting member 6*b* for supporting the elastic member 6*a*. Waste toner having been removed from the surface of the photosensitive drum 1 by the cleaning blade 6 is housed in a removed toner housing section which is formed by the cleaning blade 6 and the cleaning frame. Moreover, in the present embodiment, a configuration including the developing roller 22, the container main body 19, and the stirring sheet 23*b* will be referred to as a developer container 190.

Configuration of Seal Provided in Developing Chamber 18*b*

Figure 4A:
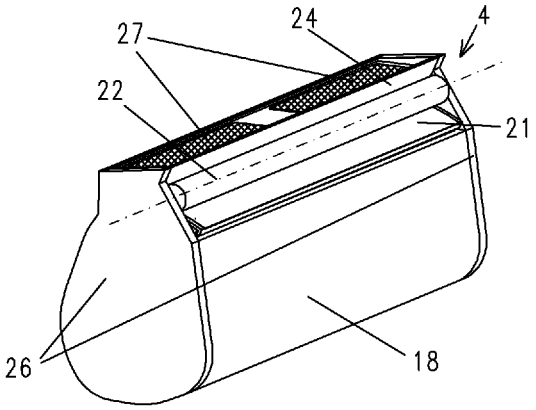
FIGS. 4A to 4D are perspective views and a schematic sectional view of a developing unit according to an embodiment.
Figure 4B:
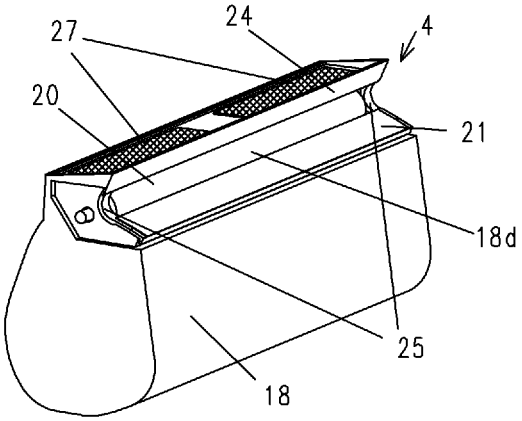
Figure 4C:
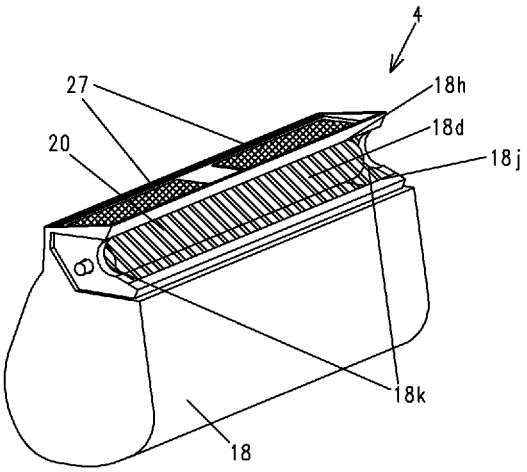
Figure 4D:
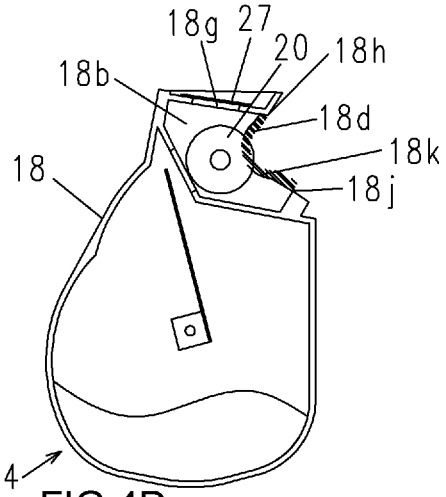

Next, a configuration of the developing chamber 18*b* will be described with reference to FIGS. 1 and 4A to 4D. FIG. 1 is a schematic sectional view of the process cartridge 7 according to the present embodiment. In addition, FIGS. 4A to 4D show perspective views and a schematic sectional view of the developing unit 4 according to the embodiment. Specifically, FIG. 4A is a perspective view of the developing unit 4, and FIG. 4B is a perspective view of the developing unit 4 in a state where a bearing unit 26 and the developing roller 22 have been removed. Furthermore, FIG. 4C is a perspective view of the developing unit 4 in a state where an elastic sheet 24, the developing blade 21, and end seal members 25 have been removed from the developing unit 4 shown in FIG. 4B. FIG. 4D is a schematic sectional view of the developing unit 4 shown in FIG. 4B.

As shown in FIGS. 4C and 4D, the developing chamber 18*b* is provided with a developer opening 18*d* (which corresponds to the third opening) which is enclosed by an upper edge section 18*h*, a lower edge section 18*j*, and both edge sections 18*k*. In the developer opening 18*d*, the developing roller 22 which bears toner is provided so as to be rotatable by the bearing unit 26. In addition, as shown in FIGS. 4A and 4B, at the lower edge section 18*j* of the developer opening 18*d*, the developing blade 21 which extends toward a surface of the developing roller 22 and which adjusts a thickness of a toner layer on the developing roller 22 is provided on the developing frame 18.

In this case, as shown in FIG. 4C, a length of the developer opening 18*d* in the rotational axis direction of the developing roller 22 is longer than a length of the developer opening 18*d* in a direction orthogonal to the rotational axis direction of the developing roller 22. In other words, a longitudinal direction of the developer opening 18*d* is the same as the rotational axis direction of the developing roller 22. A transverse direction of the developer opening 18*d* is the same as the direction orthogonal to the rotational axis direction of the developing roller 22. Furthermore, the upper edge section 18*h* and the lower edge section 18*j* are edge sections which extend in the longitudinal direction of the developer opening 18*d*. The both edge sections 18*k* correspond to the ends of the developer opening 18*d* in the longitudinal direction. The both edge sections 18*k* are edge sections which extend in the transverse direction of the developer opening 18*d*.

Meanwhile, the developing frame 18 is provided with the elastic sheet (which corresponds to the sealing sheet) 24 in the upper edge section 18*h* of the developer opening 18*d*. One end of the elastic sheet 24 is attached to the developing frame 18. As shown in FIGS. 4A to 4D, one end of the elastic sheet 24 is attached to the upper edge section 18*h*. In other words, the upper edge section 18*h* is a fixed section to which the elastic sheet 24 is fixed. Another end of the elastic sheet 24 is in contact with the developing roller 22. Accordingly, toner in the developing unit 4 is prevented from leaking from a gap between the developing roller 22 and the upper edge section 18*h*. In addition, the end seal members 25 are respectively provided in the both edge sections 18*k* that form the developer opening 18*d* so as to close gaps among the developing frame 18, the developing roller 22, the developing blade 21, and the elastic sheet 24. The end seal members 25 are flexible and, when attached to the developing unit 4, come into pressure contact with an outer circumferential surface of the developing roller 22, a rear surface of the developing blade 21, and a rear surface of the elastic sheet 24. Accordingly, leakage of the toner inside the developer unit 4 in vicinities of both ends of the developing roller 22 in the rotational axis direction thereof is suppressed. In other words, as shown in FIGS. 4A to 4D, the elastic sheet 24 is in contact with the developing roller 22 between an inner-side end of the end seal member 25 provided at one end and an inner-side end of the end seal member 25 provided at another end of the developer opening 18*d* in the longitudinal direction. Both the elastic sheet 24 and the end seal members 25 function as a sealing member that prevents the developer from leaking out from between the developing frame 18 and the developing roller 22.

Configuration for Transporting Toner to Developing Chamber 18*b*

Next, a configuration for conveying toner inside the toner storage chamber 18*a* (which corresponds to inside of the developer storage chamber) to the developing chamber 18*b* will be described with reference to FIGS. 5A to 5E. In this case, FIGS. 5A to 5E are diagrams showing how toner inside the toner storage chamber 18*a* is conveyed to the developing chamber 18*b*. In the present embodiment, the stirring sheet 23*b* abuts against the inner wall surface of the toner storage chamber 18*a* and rotates in the toner storage chamber 18*a* in a bended state.

In addition, the release position 18*e* at which the stirring sheet 23*b* is restored from the bended state to its original state (an unbended state) is provided in the toner storage chamber 18*a*. In the present embodiment, on the inner wall surface of the toner storage chamber 18*a*, a portion of the release position 18*e* has a protruding shape with respect to a peripheral portion of the release position 18*e*. When passing the release position 18*e*, the stirring sheet 23*b* kicks up toner deposited on the stirring sheet 23*b* due to a restorative force created when the stirring sheet 23*b* is restored from the bended state to the original state. Accordingly, the toner on the stirring sheet 23*b* is conveyed to the toner supplying roller 20 in the developing chamber 18*b* via the opening 18*c*. In other words, the stirring sheet 23*b* is deformable and conveys toner when the deformation is released.

Let a length W0 denote a length (distance) between a tip of the stirring sheet 23*b* to a center of the rotating shaft 23*a* (the rotational axis of the stirring sheet 23*b*) in a state where the stirring sheet 23*b* is not bended (a natural state). In addition, let a length W1 denote a length from the bottom section 18*f* of the toner storage chamber 18*a* to the rotating shaft 23*a*. In this case, the bottom section 18*f* is a portion at a lowermost position in a normally-used posture of the developing unit 4 in the bottom section of the toner storage chamber 18*a*. Furthermore, let a length W2 denote a length from an edge section at a lower position among the edge sections of the opening 18*c* to the rotating shaft 23*a* in a cross section sliced at a plane orthogonal to a rotational axis direction of the rotating shaft 23*a* (a cross section sliced at a plane orthogonal to the rotational axis of the stirring sheet 23*b*). In addition, in the present embodiment, length W0>length W1 is satisfied as shown in FIG. 1 so that toner in the bottom section 18*f* of the toner storage chamber 18*a* is also conveyed to the developing chamber 18*b*. Furthermore, length W0>length W2 is satisfied so that toner can be supplied to the developing chamber 18*b* in a stable manner. In other words, the distance between the tip of the stirring sheet 23*b* and the rotational axis of the stirring sheet 23*b* in a state where the stirring sheet 23*b* is not bended is larger than a shortest distance between the opening 18*c* and the rotational axis of the stirring sheet 23*b*. Moreover, by setting the length W0 of the stirring sheet 23*b* longer than the length W2, when the stirring sheet 23*b* rotates, the stirring sheet 23*b* may collide with the toner supply opening 18*c* and may facilitate a fluctuation in pressure inside the developing chamber 18*b*. A pressure fluctuation in such a case can be suppressed using a ventilation opening to be described later. As shown in FIG. 1, in a sectional direction that is orthogonal to the rotational axis of the stirring sheet 23*b* (an orthogonal direction that is orthogonal to the direction of the rotational axis of the stirring sheet 23*b*), a ventilation opening 18*g* connects an interior of the developing chamber 18*b* and an exterior of the developing frame 18 with each other.

Figure 5A:
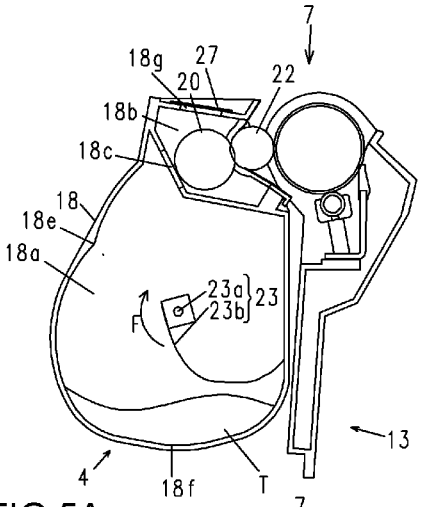
FIGS. 5A to 5E are diagrams showing how toner in a toner storage chamber is conveyed to a developing chamber.
Figure 5B:
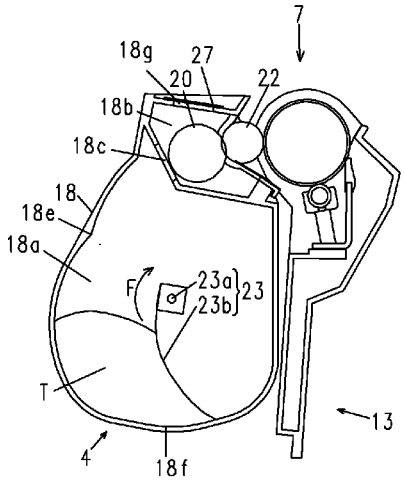

Next, a situation where states of the stirring sheet 23*b* and toner change as the stirring member 23 makes one rotation will be described with reference to FIGS. 5A to 5E. FIG. 5A shows a state before the rotating stirring sheet 23*b* starts to push toner loaded in the toner storage chamber 18*a*. Subsequently, in FIG. 5B, as the stirring sheet 23*b* further rotates in a direction of an arrow F, the stirring sheet 23*b* starts to lift up the toner in the toner storage chamber 18*a*.

Figure 5C:
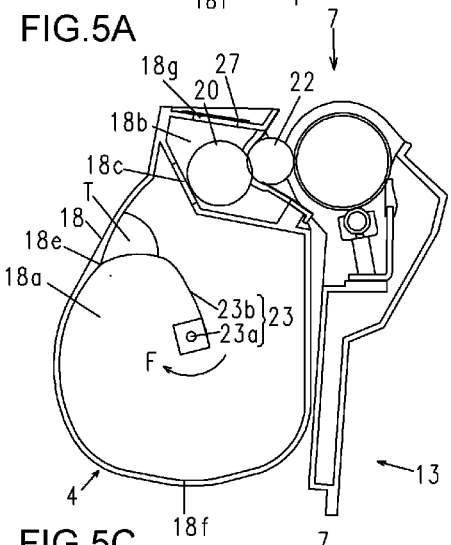
Figure 5D:
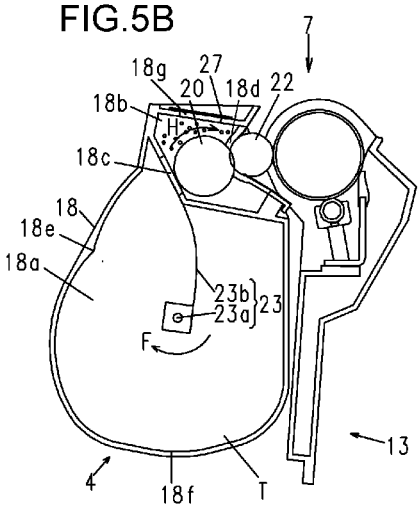

In FIG. 5C, the tip of the rotating stirring sheet 23*b* reaches the release position 18*e*. Toner is deposited on the stirring sheet 23*b*, and when the tip of the stirring sheet 23*b* passes the release position 18*e*, the stirring sheet 23*b* is restored from the bended state to the original state. Accordingly, as shown in FIG. 5D, the toner on the stirring sheet 23*b* is kicked up toward the opening 18*c* and the developing roller 22 due to a restorative force created when the stirring sheet 23*b* is restored. In addition, due to the stirring sheet 23*b* colliding with the edge sections of the opening 18*c*, the toner on the stirring sheet 23*b* is pushed into the developing chamber 18*b*. In other words, the opening 18*c* is an opening for connecting the toner storage chamber 18*a* and the developing chamber 18*b* with each other to allow passage of toner conveyed from the toner storage chamber 18*a* to the developing chamber 18*b*.

At this point, as shown in FIG. 5D, the toner conveyed from the toner storage chamber 18*a* to the developing chamber 18*b* via the opening 18*c* passes above the toner supplying roller 20 and is conveyed in a direction of an arrow H toward the developer opening 18*d*. In addition, the toner conveyed toward the developer opening 18*d* proceeds to a portion where the toner supplying roller 20 and the developing roller 22 come into contact with each other, and a part of the toner is supplied to the developing roller 22.

Figure 5E:
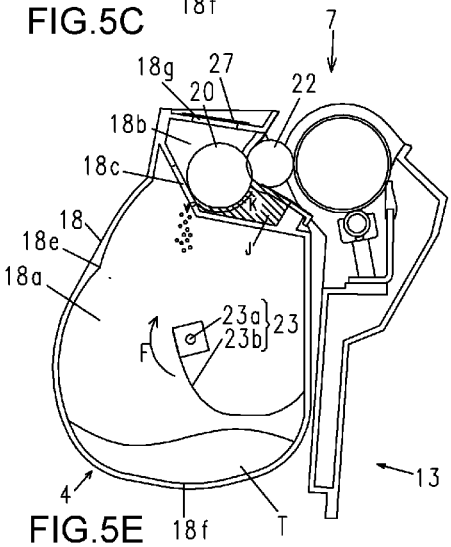

Toner not supplied to the developing roller 22 is conveyed by rotations of the developing roller 22 and the toner supplying roller 20 to a region J enclosed by a wall surface forming the developing chamber 18*b*, the developing blade 21 (refer to FIG. 1), the developing roller 22, and the toner supplying roller 20. In addition, as shown in FIG. 5E, once a sufficient amount of toner is supplied to the developing chamber 18*b*, the region J becomes filled with the toner and excess toner is returned to the toner storage chamber 18*a* (conveyed in a direction of an arrow K) via the opening 18*c* due to a rotation of the toner supplying roller 20.

Configuration of Ventilation Opening 18*g* and Filter 27

Figure 6B:
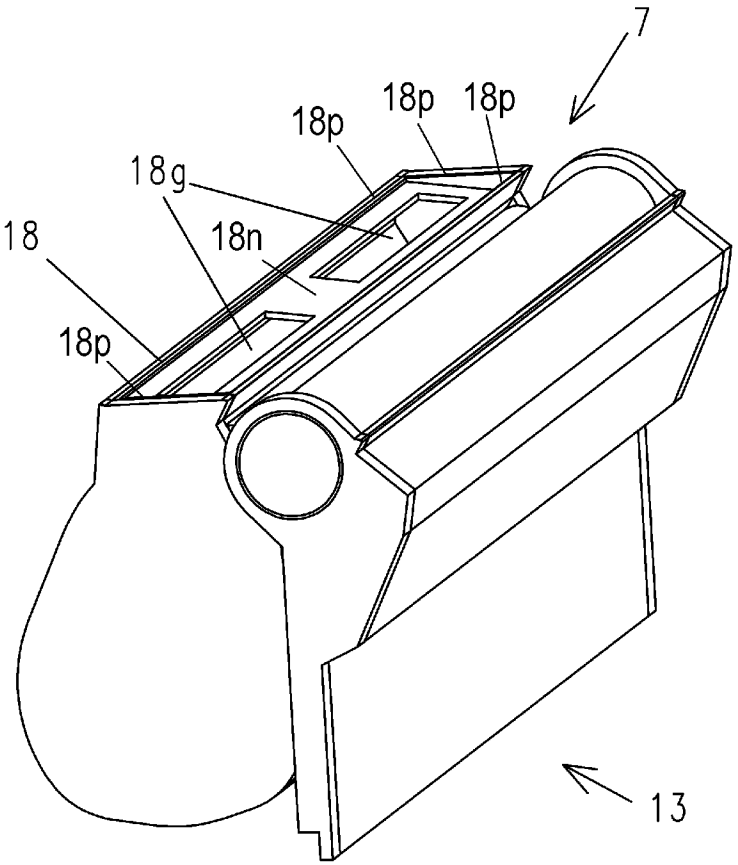
FIGS. 6A and 6B are perspective views of a process cartridge according to an embodiment.
Figure 6A:
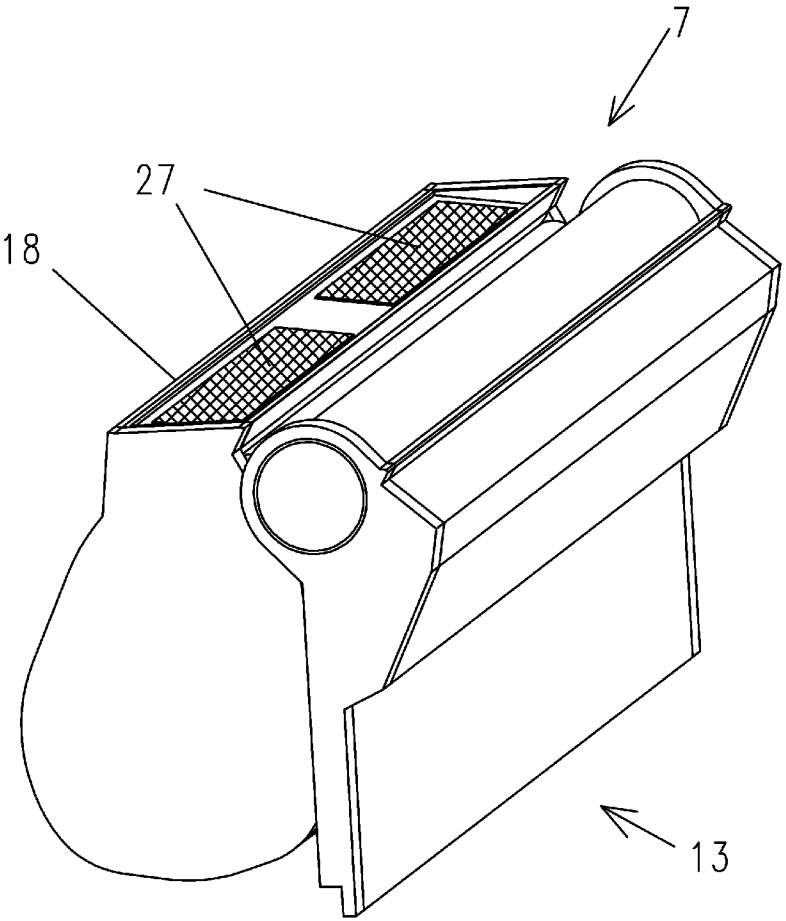
Figure 7:
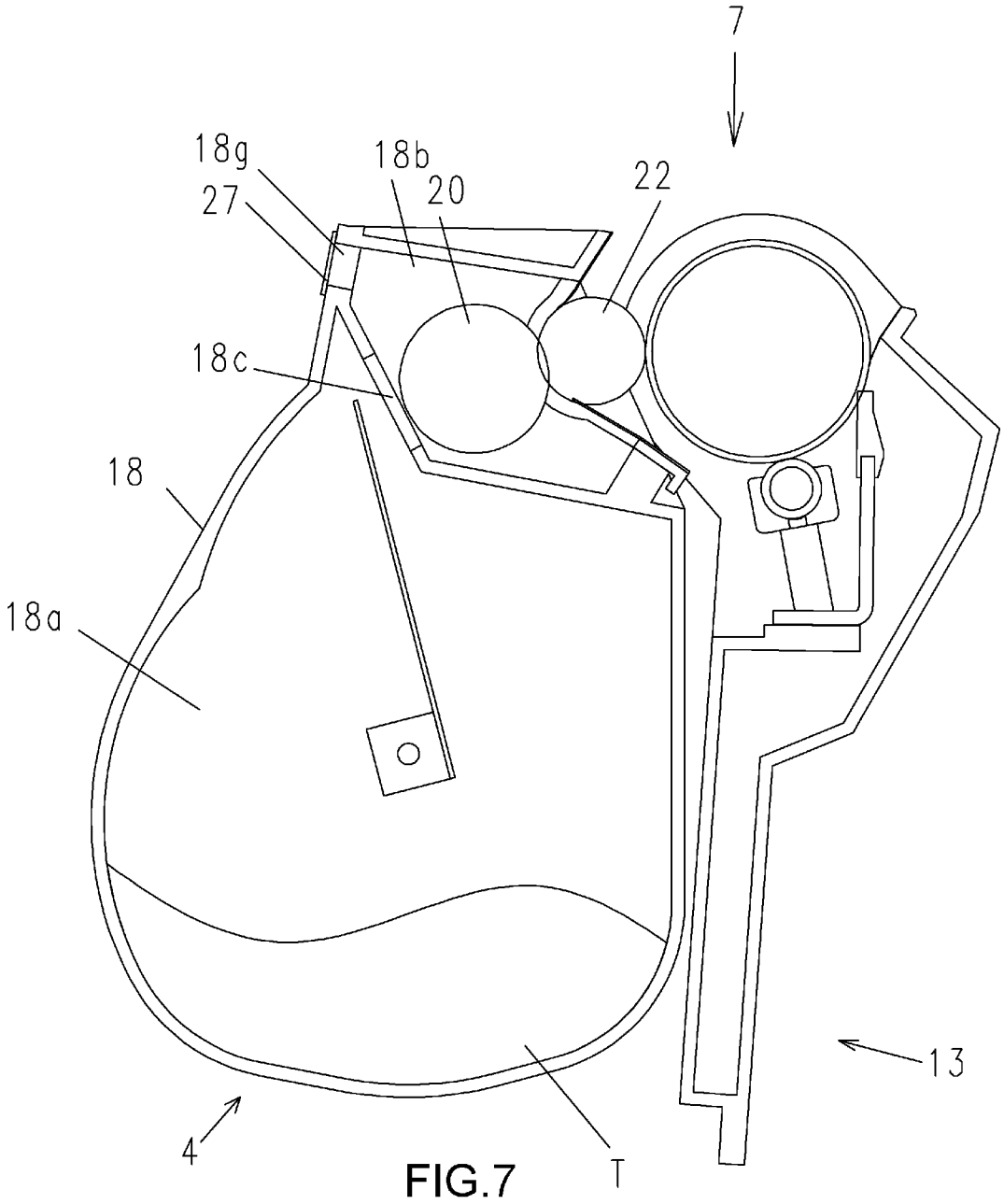
FIG. 7 is a schematic sectional view of a process cartridge according to an embodiment.

In the present embodiment, by providing the developing frame 18 with the ventilation opening 18*g* (which corresponds to the second opening) and a filter 27, a rise in pressure inside the developing chamber 18*b* and a leakage of toner into the developing chamber 18*b* (which corresponds to the outside of the developing chamber) are effectively suppressed. The ventilation opening 18*g* connects the inside and the outside of the developing chamber 18*b* with each other. The ventilation opening 18*g* and the filter 27 will now be described with reference to FIGS. 1, 6A, 6B, and 7. FIGS. 6A and 6B are perspective views of the process cartridge 7 according to the present embodiment, and FIG. 7 is a schematic sectional view of the process cartridge 7 according to the present embodiment. Specifically, FIG. 6A is a perspective view of the process cartridge 7, and FIG. 6B is a perspective view of the process cartridge 7 in a state where the filter 27 has been removed. In addition, specifically, FIG. 7 is a sectional view of a process cartridge in a case where the ventilation opening 18*g* is provided at a position that differs from the developing frame 18 shown in FIG. 1.

As shown in FIGS. 1, 6A, and 6B, the ventilation opening 18*g* is formed so as to extend in a longitudinal direction of the developing unit 4 (the rotational axis direction of the rotating shaft 23*a*) on a wall surface forming the developing chamber 18*b*. In other words, a length of the ventilation opening 18*g* in the direction of the rotational axis of the rotating shaft 23*a* (the rotational axis of the stirring sheet 23*b*) is longer than a length of the ventilation opening 18*g* in a direction orthogonal to the rotational axis direction of the rotating shaft 23*a* (a transverse direction of the developing unit 4). Due to the formation of the ventilation opening 18*g* on the developing frame 18, an exterior of the developing unit 4 and the developing chamber 18*b* communicate with each other via the ventilation opening 18*g*. As described earlier, in an orthogonal direction that is orthogonal to the direction of the rotational axis of the stirring sheet 23*b*, the ventilation opening 18*g* connects the interior of the developing chamber 18*b* and the exterior of the developing frame 18 with each other (FIG. 1). By arranging the ventilation opening 18*g* in such a direction, a pressure fluctuation inside the developing chamber 18*b* due to the stirring sheet 23*b* can be effectively reduced. In addition, in the present embodiment, the ventilation opening 18*g* is given a rectangular shape and is provided across a wide region in the longitudinal direction of the developing unit 4. Moreover, for example, as shown in FIGS. 1 and 4D, in the orthogonal direction to the rotational axis of the stirring member 23, the ventilation opening 18*g* and the opening 18*c* are configured so as to intersect with a single cross section. Specifically, when viewed from the orthogonal direction, at least a part of the ventilation opening 18*g* and at least a part of the opening 18*c* overlap with each other. In other words, in the axial direction (longitudinal direction) of the rotating shaft 23*a*, a range of the ventilation opening 18*g* and a range of the opening 18*c* at least partially overlap with each other. Moreover, at least one ventilation opening 18*g* may be formed on the developing frame 18 and, the larger an area of the ventilation opening 18*g*, the greater the reduction in pressure of the developing chamber 18*b*. In the present embodiment, in order to sufficiently secure rigidity of the developing frame 18 and to sufficiently reduce the pressure in the developing chamber 18*b*, the ventilation opening 18*g* is provided at two locations on the developing frame 18.

As shown in FIG. 1, a connecting wall 18*n* is connected to the fixed section (the upper edge section 18*h*). The connecting wall 18*n* extends in a direction intersecting a direction in which the elastic sheet 24 extends in the orthogonal direction (the direction orthogonal to the direction of the rotational axis of the developing roller 22 or the rotational axis of the stirring sheet 23*b*). The connecting wall 18*n* can also be described a wall surface supporting the upper edge section 18*h* that is the fixed section in a thickness direction of the elastic sheet 24. In the configuration shown in FIG. 1, the ventilation opening 18*g* is provided on the connecting wall 18*n*.

In the present embodiment, as shown in FIGS. 4A to 4D, 6A, and 6B, the ventilation opening 18*g* is provided at two locations. In this case, the ventilation opening 18*g* is not provided at a center of the developer opening 18*d* in the longitudinal direction of the developer opening 18*d*. In other words, in the longitudinal direction, the ventilation opening 18*g* is arranged at a position offset from a center position of the developer opening 18*d*. Specifically, in the longitudinal direction of the developer opening 18*d*, a center position of the developer opening 18*d* and a position of the connecting wall 18*n* of the ventilation opening 18*g* overlap with each other.

By providing the ventilation opening 18*g* on the connecting wall 18*n* that is a nearest wall surface to the developer opening 18*d*, pressure can be effectively reduced in a vicinity of the developer opening 18*d*. In addition, the rigidity of the developing frame 18 (in particular, the connecting wall 18*n*) can be increased in a central section in the longitudinal direction.

Furthermore, as shown in FIG. 6B, protruded portions 18*p* are provided in a periphery of the ventilation opening 18*g*. Accordingly, the rigidity of the developing frame 18 can be increased in the periphery of the ventilation opening 18*g*. In the present embodiment, the protruded portions 18*p* are extended along the longitudinal direction and the transverse direction of the ventilation opening 18*g*. In addition, the respective protruded portions 18*p* are provided on both sides of the ventilation opening 18*g*. Moreover, the protruded portions 18*p* may include a portion extended in the transverse direction so as to traverse between the ventilation openings 18*g* at a longitudinal center of the opening 18*c*.

As shown in FIG. 1, let a first line L1 denote a line connecting one end of the ventilation opening 18*g* and one end of the opening 18*c* in a direction orthogonal to the rotating shaft 23*a*. In addition, let a second line L2 denote a line connecting another end of the ventilation opening 18*g* and another end of the opening 18*c*. In this case, a region between the first line L1 and the second line L2 may be considered a region that includes a shortest path among paths traveled by air having passed through the opening 18*c* to reach the ventilation opening 18*g*. In the configuration shown in FIG. 1, the supplying roller 20 is arranged so that at least a part thereof is positioned outside the region between the first line L1 and the second line L2. Accordingly, narrowing of the region between the first line L1 and the second line L2 by the supplying roller 20 can be reduced. Moreover, in a configuration in which the ventilation opening 18*g* is provided in plurality, all of the ventilation openings 18*g* need not be arranged as described above. In other words, a part of the ventilation openings 18*g* and the supplying roller 20 may be in the arrangement relationship described above.

In addition, in the present embodiment, the ventilation opening 18*g* is provided on a top surface (the connecting wall 18*n*) of the developing frame 18. Since the region J in the developing chamber 18*b* is basically always filled with toner, the ventilation opening 18*g* is provided on a surface that does not constitute the region J among the wall surfaces forming the developing chamber 18*b*. Accordingly, even when the developing unit 4 is being used, pressure inside the developing chamber 18*b* can be reduced without the toner inside the developing chamber 18*b* blocking the ventilation opening 18*g*.

Furthermore, the wall surface on which the ventilation opening 18*g* is provided is a wall surface of which one surface forms an inner wall of the developing chamber 18*b* and another surface being a rear surface of the one surface forms a part of an outer wall of the developing frame 18. As shown in FIG. 1, by providing the ventilation opening 18*g* on a largest wall surface among the wall surfaces described above, a size of the ventilation opening 18*g* can be made larger. Moreover, in the present embodiment, while the ventilation opening 18*g* is provided on the top surface of the developing frame 18, for example, the ventilation opening 18*g* may be provided on a side surface of the developing frame 18 as shown in FIG. 7.

In addition, as shown in FIG. 5D, the ventilation opening 18*g* is arranged on an upstream side relative to the developer opening 18*d* and on a downstream side relative to the opening 18*c* in a direction in which toner is conveyed in the developing chamber 18*b* (a rotation direction of the toner supplying roller 20 (the direction of the arrow H)). Furthermore, on a supply path through which toner is supplied to a side of the developer opening 18*d* from a side of the opening 18*c* (which corresponds to the opening side) by the toner supplying roller 20, the ventilation opening 18*g* is positioned between the opening 18*c* and the developer opening 18*d*. Therefore, air conveyed from the toner storage chamber 18*a* by the stirring sheet 23*b* is discharged from the ventilation opening 18*g* before reaching the developer opening 18*d* which is susceptible to leakage of toner. Accordingly, pressure of the developing chamber 18*b* can be effectively reduced and leakage of toner from the developer opening 18*d* can be suppressed.

Furthermore, on the developing frame 18, the ventilation opening 18*g* is provided up to vicinities of both ends in the longitudinal direction of the developing unit 4. Accordingly, pressure can be more effectively prevented from being applied to the end seal members 25 arranged at both ends of the developer opening 18*d* (both ends in the longitudinal direction of the developing unit 4). Therefore, leakage of toner from both ends of the developer opening 18*d* can be suppressed. In addition, as shown in FIGS. 6A and 6B, the filter 27 is provided so as to cover the ventilation opening 18*g* and prevents leakage of toner from inside the developing unit 4. In other words, as shown in FIGS. 6A and 6B, the filter 27 is larger than the ventilation opening 18*g* when viewed from a normal direction of a surface to which the filter 27 is fixed. Furthermore, the filter 27 is formed of a material that allows air inside the developing chamber 18*b* to pass through.

The filter 27 is desirably formed of a material with high air permeability. The higher the air permeability of the filter 27, the higher the effect of reducing pressure of the developing chamber 18*b*. Therefore, the higher the air permeability of the filter 27, the further leakage of toner inside the developing chamber 18*b* can be suppressed. Moreover, in the present embodiment, the filter 27 is attached to the developing frame 18 by welding from an outer side of the wall surface of the developing frame 18. However, a method of fixing the filter 27 to the developing frame 18 is not solely limited to welding and, for example, the filter 27 may be fixed to the developing frame 18 by a double-coated adhesive tape, an adhesive, or the like. In addition, for example, the filter 27 may be fixed from an inner side of the developing unit 4. Furthermore, the filter 27 may be integrally attached to the developing frame 18 by being insert-molded with respect to the developing unit 4. The filter 27 need only be fixed to the developing unit 4 so that air inside the developing chamber 18*b* is discharged through the filter 27 and, at the same time, leakage of toner inside the developing chamber 18*b* from the ventilation opening 18*g* can be suppressed.

Figure 8A:
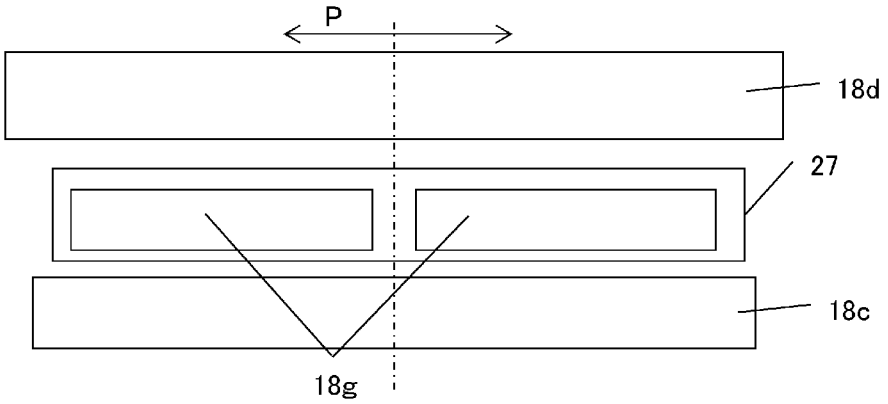
FIGS. 8A to 8C are diagrams illustrating an arrangement example of a ventilation opening and a filter according to an embodiment.
Figure 8B:
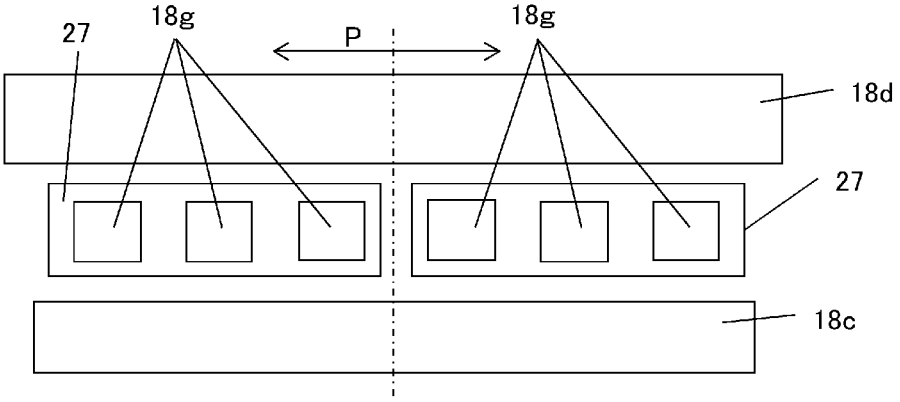
Figure 8C:
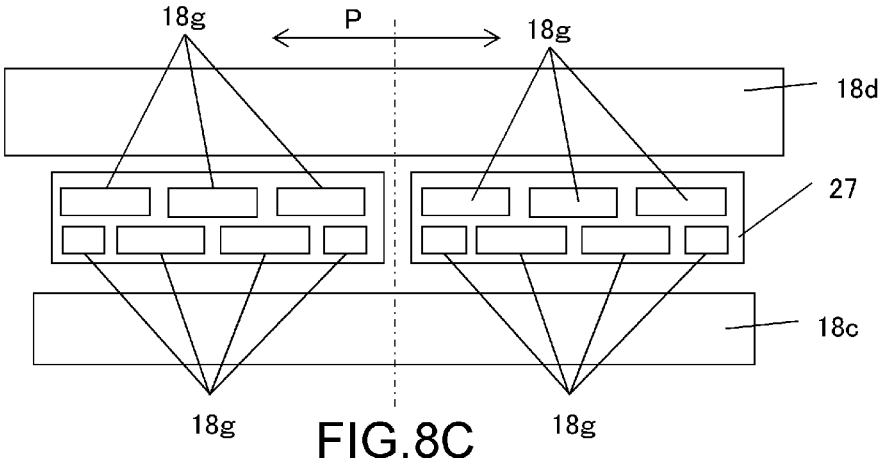

In addition, the number of filters 27 attached to the developing unit 4 need only be at least one and the number of filters 27 is not particularly limited. In the present embodiment, two filters 27 respectively cover the two ventilation openings 18*g*. However, the number of ventilation openings 18*g* and the number of filters 27 need not necessarily be the same and, for example, a plurality of ventilation openings 18*g* may be covered by a single filter 27. Specifically, the ventilation openings 18*g* and the filters 27 can also be arranged as shown in FIGS. 8A to 8C. FIGS. 8A to 8C are diagrams showing arrangement examples of the ventilation openings 18*g* and the filters 27 according to the present embodiment. FIGS. 8A to 8C are schematic views of the ventilation openings 18*g*, the filters 27, the opening 18*c*, and the developer opening 18*d* as respectively viewed from a direction orthogonal to the rotational axis direction of the stirring sheet 23*b*. An arrow P represents the rotational axis direction of the stirring sheet 23*b*. Moreover, in FIGS. 8A to 8C, portions other than the ventilation openings 18*g*, the filters 27, the opening 18*c*, and the developer opening 18*d* are omitted. When viewed from the direction of the rotational axis of the stirring sheet 23*b*, the ventilation opening 18*g* can be arranged at the position shown in FIG. 1. In addition, the ventilation opening 18*g* can also be arranged at the position shown in FIG. 7.

As described above, in the present embodiment, in the developing unit 4 in which toner is conveyed from the toner storage chamber 18*a* to the developing chamber 18*b* due to the rotation of the stirring sheet 23*b* inside the toner storage chamber 18*a*, the ventilation opening 18*g* is provided on a wall section forming the developing chamber 18*b*. Accordingly, even when air is conveyed into the developing chamber 18*b* by the stirring sheet 23*b*, an increase in the pressure inside the developing chamber 18*b* can be suppressed and leakage of toner from the developing chamber 18*b* can be suppressed.

In addition, in the present embodiment, the ventilation opening 18*g* is covered by the filter 27 which allows air to pass through while preventing toner from passing through. In other words, the filter 27 allows passage of air through the ventilation opening 18*g* but restricts passage of toner through the ventilation opening 18*g*. Accordingly, an increase in the pressure inside the developing chamber 18*b* can be suppressed and, at the same time, leakage of toner from the developing chamber 18*b* via the ventilation opening 18*g* can be suppressed. In the present embodiment, a non-woven fabric with a mean bore diameter of 5 μm is used as a material of the filter in order to ensure collecting performance and air permeability. Furthermore, in the present embodiment, the developing unit 4 is arranged on an opposite side of the fixing apparatus 10 with respect to the intermediate transfer belt 5. Accordingly, an impact of heat generated by the fixing apparatus 10 on the developing unit 4 can be suppressed.

Moreover, in the present embodiment, the ventilation opening 18*g* need not necessarily be covered by the filter 27. As long as air is discharged but toner is not discharged from the ventilation opening 18*g*, the member covering the ventilation opening 18*g* need not necessarily be the filter 27.

In addition, in the present embodiment, the developing chamber 18*b* need not necessarily be arranged above the toner storage chamber 18*a*. For example, the developing chamber 18*b* may be arranged adjacent to the toner storage chamber 18*a* in the horizontal direction.

According to the present invention, in a developer container in which toner is conveyed from a toner storage chamber to a developing chamber by a rotation of a stirring member, leakage of the toner from inside the developing chamber can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-212464, filed Oct. 31, 2016, and Japanese Patent Application No. 2017-169287, filed on Sep. 4, 2017, which are hereby incorporated by reference herein in their entirety.

What is claimed is:

1. A developer container, comprising:

a developer bearing member for bearing a developer;

a supplying member for supplying the developer to the developer bearing member by coming in to contact with the developer bearing member;

a conveying member which conveys the developer;

a frame which stores the developer, the frame including (i) a developer storage chamber which stores the conveying member, (ii) a developing chamber in which the developer bearing member and the supplying member are arranged, (iii) a partition partitioning the developer storage chamber and the developing chamber, the partition provided with a first opening which connects the developer storage chamber and the developing chamber, and (iv) a second opening which connects an interior of the developing chamber and an exterior of the frame with each other in a direction that is orthogonal to a direction of a rotational axis of the conveying member;

a filter which allows passage of air and which restricts passage of the developer, the filter being fixed to the frame so as to cover the second opening, wherein the conveying member is deformable such that the developer is conveyed from the developer storage chamber to the developing chamber via the first opening by deformation of the conveying member being released, wherein the conveying member is configured to convey the developer such that the developer passes above the supplying member, and wherein the second opening includes a first ventilation opening and a second ventilation opening which connect the interior of the developing chamber and the exterior of the frame with each other in the orthogonal direction.

2. The developer container according to claim 1, wherein the developing chamber is provided with a third opening in which the developer bearing member is arranged, and wherein the second opening is arranged in an upstream side of the third opening and a downstream side of the first opening with respect to a rotation direction of the supplying member.

3. The developer container according to claim 1, wherein at least part of the second opening is arranged directly above the supplying member.

4. The developer container according to claim 1, wherein the filter covers the first ventilation opening and the second ventilation opening.

5. The developer container according to claim 4, wherein the filter is fixed to the frame so as to cover the second opening from an outer side of the frame.

6. The developer container according to claim 1, wherein the filter includes a first filter covering the first ventilation opening and a second filter covering the second ventilation opening.

7. The developer container according to claim 1, wherein the filter is fixed to the frame so as to cover the second opening from an outer side of the frame.

8. The developer container according to claim 1, further comprising:

a sealing sheet which is fixed to the frame, the sealing sheet coming into contact with the developer bearing member so as to suppress leakage of the developer from a gap formed between the frame and the developer bearing member, wherein the frame includes a fixed section in which the sealing sheet is fixed, and a wall which is connected to the fixed section, wherein the second opening is provided on the wall.

9. The developer container according to claim 8, wherein the frame includes a protruded portion projecting toward a direction crossing the wall, the protruded portion is disposed so as to surround the second opening.

10. The developer container according to claim 1, wherein the developing chamber is arranged above the developer storage chamber in a posture in which the developer container is normally used, and the conveying member conveys the developer from the developer storage chamber to the developing chamber by lifting up the developer stored in the developer storage chamber.

11. The developer container according to claim 1, wherein the filter is fixed to the frame by at least one of welding, a double-coated adhesive tape, an adhesive, and insert-molding.

12. A developer container, comprising:

a developer bearing member for bearing a developer;

a supplying member for supplying the developer to the developer bearing member by coming in to contact with the developer bearing member;

a conveying member which conveys the developer;

a frame which stores the developer, the frame including (i) a developer storage chamber which stores the conveying member, (ii) a developing chamber in which the developer bearing member and the supplying member are arranged, (iii) a partition partitioning the developer storage chamber and the developing chamber, the partition provided with a first opening which connects the developer storage chamber and the developing chamber, and (iv) a second opening which connects an interior of the developing chamber and an exterior of the frame with each other in a direction that is orthogonal to a direction of a rotational axis of the conveying member;

a filter which allows passage of air and which restricts passage of the developer, the filter being fixed to the frame so as to cover the second opening, wherein the conveying member is deformable such that the developer is conveyed from the developer storage chamber to the developing chamber via the first opening by deformation of the conveying member being released, and wherein at least part of the second opening is arranged directly above the supplying member, and wherein the second opening includes a first ventilation opening and a second ventilation opening which connect the interior of the developing chamber and the exterior of the frame with each other in the orthogonal direction.

13. The developer container according to claim 12, wherein the developing chamber is provided with a third opening in which the developer bearing member is arranged, and wherein the second opening is arranged in an upstream side of the third opening and a downstream side of the first opening with respect to a rotation direction of the supplying member.

14. The developer container according to claim 12, wherein the filter covers the first ventilation opening and the second ventilation opening.

15. The developer container according to claim 12, wherein the filter includes a first filter covering the first ventilation opening and a second filter covering the second ventilation opening.

16. The developer container according to claim 15, wherein the filter is fixed to the frame so as to cover the second opening from an outer side of the frame.

17. The developer container according to claim 12, wherein the filter is fixed to the frame so as to cover the second opening from an outer side of the frame.

18. The developer container according to claim 12, further comprising:

a sealing sheet which is fixed to the frame, the sealing sheet coming into contact with the developer bearing member so as to suppress leakage of the developer from a gap formed between the frame and the developer bearing member, wherein the frame includes a fixed section in which the sealing sheet is fixed, and a wall which is connected to the fixed section, wherein the second opening is provided on the wall.

19. The developer container according to claim 18, wherein the frame includes a protruded portion projecting toward a direction crossing the wall, the protruded portion is disposed so as to surround the second opening.

20. The developer container according to claim 12, wherein the developing chamber is arranged above the developer storage chamber in a posture in which the developer container is normally used, and the conveying member conveys the developer from the developer storage chamber to the developing chamber by lifting up the developer stored in the developer storage chamber.

21. The developer container according to claim 12, wherein the filter is fixed to the frame by at least one of welding, a double-coated adhesive tape, an adhesive, and insert-molding.

22. A developer container, comprising:

a developer bearing member for bearing a developer;

a supplying member for supplying the developer to the developer bearing member by coming in to contact with the developer bearing member;

a conveying member which conveys the developer;

a frame which stores the developer, the frame including (i) a developer storage chamber which stores the conveying member, (ii) a developing chamber in which the developer bearing member and the supplying member are arranged, (iii) a partition partitioning the developer storage chamber and the developing chamber, the partition provided with a first opening which connects the developer storage chamber and the developing chamber, and (iv) a second opening which connects an interior of the developing chamber and an exterior of the frame with each other in a direction that is orthogonal to a direction of a rotational axis of the conveying member;

a filter which allows passage of air and which restricts passage of the developer, the filter being fixed to the frame so as to cover the second opening, wherein the conveying member is deformable such that the developer is conveyed from the developer storage chamber to the developing chamber via the first opening by deformation of the conveying member being released, wherein the developing chamber is provided with a third opening in which the developer bearing member is arranged, and wherein the second opening is arranged in an upstream side of the third opening and a downstream side of the first opening with respect to a rotation direction of the supplying member.

23. The developer container according to claim 22, wherein the second opening includes a first ventilation opening and a second ventilation opening which connect the interior of the developing chamber and the exterior of the frame with each other in the orthogonal direction.

24. The developer container according to claim 23, wherein the filter covers the first ventilation opening and the second ventilation opening.

25. The developer container according to claim 24, wherein the filter is fixed to the frame so as to cover the second opening from an outer side of the frame.

26. The developer container according to claim 23, wherein the filter includes a first filter covering the first ventilation opening and a second filter covering the second ventilation opening.

27. The developer container according to claim 22, further comprising:

a sealing sheet which is fixed to the frame, the sealing sheet coming into contact with the developer bearing member so as to suppress leakage of the developer from a gap formed between the frame and the developer bearing member, wherein the frame includes a fixed section in which the sealing sheet is fixed, and a wall which is connected to the fixed section, wherein the second opening is provided on the wall.

28. The developer container according to claim 27, wherein the frame includes a protruded portion projecting toward a direction crossing the wall, the protruded portion is disposed so as to surround the second opening.

29. The developer container according to claim 22, wherein the developing chamber is arranged above the developer storage chamber in a posture in which the developer container is normally used, and the conveying member conveys the developer from the developer storage chamber to the developing chamber by lifting up the developer stored in the developer storage chamber.

30. The developer container according to claim 22, wherein the filter is fixed to the frame by at least one of welding, a double-coated adhesive tape, an adhesive, and insert-molding.

31. The developer container according to claim 22, wherein the conveying member is configured to convey the developer such that the developer passes above the supplying member.

32. The developer container according to claim 22, wherein at least part of the second opening is arranged directly above the supplying member.

* * * * *